US009368879B1

(12) United States Patent
Manry, Jr.

(10) Patent No.: US 9,368,879 B1
(45) Date of Patent: Jun. 14, 2016

(54) ULTRA WIDE BAND ANTENNA ELEMENT

(75) Inventor: Charles W Manry, Jr., Auburn, WA (US)

(73) Assignee: The Boeing Company, Chicago, IL (US)

( * ) Notice: Subject to any disclaimer, the term of this patent is extended or adjusted under 35 U.S.C. 154(b) by 441 days.

(21) Appl. No.: 13/278,841

(22) Filed: Oct. 21, 2011

Related U.S. Application Data

(63) Continuation-in-part of application No. 13/115,944, filed on May 25, 2011, now Pat. No. 8,643,554.

(51) Int. Cl.
*H01Q 1/28* (2006.01)
*H01Q 21/26* (2006.01)
*H01Q 21/06* (2006.01)

(52) U.S. Cl.
CPC ..... *H01Q 21/26* (2013.01); *H01Q 21/062* (2013.01)

(58) Field of Classification Search
USPC ..... 343/705, 789, 700 MS, 797, 818, 702
See application file for complete search history.

(56) References Cited

U.S. PATENT DOCUMENTS 2,994,876 A 8/1961 Josephson
3,137,002 A 6/1964 Kaiser et al.
3,922,683 A 11/1975 Kumpebeck
4,684,952 A 8/1987 Munson et al.
4,686,536 A * 8/1987 Allcock ..... H01Q 9/065 343/700 MS
4,783,661 A 11/1988 Smith
5,173,715 A * 12/1992 Rodal ..... H01Q 21/26 343/795
5,589,834 A 12/1996 Weinberg
5,786,793 A 7/1998 Maeda et al.
5,923,289 A 7/1999 Buer et al.
6,114,996 A 9/2000 Nghiem
6,181,280 B1 1/2001 Kadambi et al.
6,359,599 B2 3/2002 Apostolos
6,380,905 B1 4/2002 Annamaa et al.
6,407,716 B1 * 6/2002 Strickland ..... H01Q 15/0013 343/797
6,448,938 B1 9/2002 Chiang et al.
6,452,568 B1 * 9/2002 Zidek ..... H01Q 1/36 343/700 MS
6,473,027 B1 10/2002 Alon
6,512,487 B1 1/2003 Taylor et al.
6,538,604 B1 3/2003 Isohätälä et al.
7,253,770 B2 8/2007 Yegin et al.
7,289,078 B2 10/2007 Navarro
7,358,920 B2 * 4/2008 Apostolos ..... H01Q 7/00 343/789

(Continued)

OTHER PUBLICATIONS

Hansen, R.C. (2004), Non-Foster and Connected Planar Arrays, Radio Sci., 39, RS4004, doi. 10.1029/2004RS003043.

(Continued)

*Primary Examiner* — Hoang V Nguyen
*Assistant Examiner* — Hai Tran
(74) *Attorney, Agent, or Firm* — Toler Law Group, PC

(57) ABSTRACT

Antenna unit cells suitable for use in antenna arrays are disclosed, as are antenna array and mounting platform such as an aircraft comprising antenna unit cells. In one embodiment, an antenna unit cell comprises a dielectric substrate having a length extending along a first axis and a width extending along a second axis, a first plurality of radiating elements disposed on a first side of the dielectric substrate, and a second plurality of radiating elements disposed on a second side of the dielectric substrate, opposite the first side. In some embodiments the first plurality of radiating elements extend to an edge of the unit cell, and the second plurality of radiating elements overlap portions of the first plurality of radiating elements. Other embodiments may be described.

26 Claims, 7 Drawing Sheets

(56) References Cited

U.S. PATENT DOCUMENTS

| | | | | |
|---|---|---|---|---|
| 7,417,598 | B2 | 8/2008 | Navarro et al. | |
| 7,612,720 | B2 * | 11/2009 | Kerselaers | 343/700 MS |
| 7,868,830 | B2 | 1/2011 | Worl et al. | |
| 7,884,768 | B2 | 2/2011 | Navarro et al. | |
| 7,889,135 | B2 | 2/2011 | Blaser et al. | |
| 7,893,867 | B2 | 2/2011 | Navarro | |
| 8,253,633 | B2 | 8/2012 | Sanz et al. | |
| 8,308,072 | B2 * | 11/2012 | Satake | H01Q 1/2208 235/451 |
| 8,643,554 | B1 | 2/2014 | Manry, Jr. et al. | |
| 2003/0043071 | A1 | 3/2003 | Lilly et al. | |
| 2007/0069968 | A1 * | 3/2007 | Moller | H01Q 9/285 343/795 |
| 2007/0097006 | A1 | 5/2007 | Brown et al. | |
| 2010/0171675 | A1 | 7/2010 | Borja et al. | |
| 2010/0201578 | A1 | 8/2010 | Parsche | |
| 2010/0330926 | A1 | 12/2010 | Monk | |

OTHER PUBLICATIONS

Schaubert, D.H., et al., Vivaldi Antenna Arrays for Wide Bandwidth and Electronic Scanning, IEEE AP-S EuCAP 2007 Conference paper.

Holland, S.S. et al., "Design and Fabrication of Low-Cost PUMA Arrays," 2011 IEEE International Symposium on Antennas and Propagation, Jul. 2011, pp. 1976-1979, 2011.

Holland, S.S. et al., "The Banyan Tree Antenna Array," IEEE Transactions on Antennas and Propagation, vol. 59, No. 11, Nov. 2011, pp. 4060-4070, 2011.

Pozar, D.M. et al., "Scan Blindness in Infinite Phased Arrays of Printed Dipoles," IEEE Transactions on Antennas and Propagation, vol. AP-32, No. 6, Jun. 1984, pp. 602-610, 1984.

* cited by examiner

ULTRA WIDE BAND ANTENNA ELEMENT

RELATED APPLICATIONS

This application is a continuation-in-part of commonly assigned U.S. patent application Ser. No. 13/115,944 to Manry, et al, filed May 25, 2011, now U.S. Pat. No. 8,643,554 entitled Ultra Wide Band Antenna Element, the disclosure of which is incorporated herein by reference in its entirety.

BACKGROUND

The subject matter described herein relates to electronic communication and sensor systems and specifically to configurations for antenna arrays for use in such systems.

Microwave antennas may be constructed in a variety of configurations for various applications, such as satellite reception, remote sensing or military communication. Printed circuit antennas generally provide antenna structures which are low-cost, lightweight, low-profile and relatively easy to mass produce. Such antennas may be designed in arrays and used for radio frequency systems such as identification of friend/foe (IFF) systems, electronic warfare systems, signals intelligence systems, personal communication service (PCS) systems, satellite communication systems, etc.

Recently, interest has developed in ultra-wide bandwidth (UWB) arrays for use in communication and sensor systems. Thus there is a need for a lightweight phased array antenna with a wide frequency bandwidth and a wide angular scan range and that is conformally mountable to a platform surface.

SUMMARY

In one embodiment, an antenna unit cell comprises a dielectric substrate having a length extending along a first axis and a width extending along a second axis, a first plurality of radiating elements disposed on a first side of the dielectric substrate, and a second plurality of radiating elements disposed on a second side of the dielectric substrate, opposite the first side. In some embodiments the first plurality of radiating elements extend to an edge of the unit cell, and the second plurality of radiating elements overlap portions of the first plurality of radiating elements.

In another embodiment, an antenna array comprising a plurality of unit cells wherein at least a subset of the unit cells comprises a dielectric substrate having a length extending along a first axis and a width extending along a second axis, a first plurality of radiating elements disposed on a first side of the dielectric substrate and a second plurality of radiating elements disposed on a second side of the dielectric substrate, opposite the first side. In some embodiments the first plurality of radiating elements extend to an edge of the unit cell and the second plurality of radiating elements overlap portions of the first plurality of radiating elements.

In another embodiment, an aircraft comprises a communication system and an antenna assembly coupled to the communication system and comprising a plurality of unit cells. At least a subset of the unit cells comprises a dielectric substrate having a length extending along a first axis and a width extending along a second axis, a first plurality of radiating elements disposed on a first side of the dielectric substrate, and a second plurality of radiating elements disposed on a second side of the dielectric substrate, opposite the first side In some embodiments the first plurality of radiating elements extend to an edge of the unit cell and the second plurality of radiating elements overlap portions of the first plurality of radiating elements.

In another embodiment, a method to make an antenna assembly comprises printing a first plurality of radiating elements on a first surface of a substrate, wherein the first plurality of radiating elements are arranged in groups of opposing pairs that form opposing dipoles disposed about a central point and printing a second plurality of radiating elements on a second surface, opposite the first surface, of the substrate. In some embodiments the second plurality of radiating elements are rectangular in shape and arranged to form opposing dipoles disposed about the central point, and the first plurality of radiating elements partially overlap the second plurality of radiating elements.

In another embodiment, a method to use an antenna assembly comprises providing an antenna array comprising a plurality of unit cells, at least a subset of the unit cells comprising a dielectric substrate having a length extending along a first axis and a width extending along a second axis, a first plurality of radiating elements disposed on a first side of the dielectric substrate, and a second plurality of radiating elements disposed on a second side of the dielectric substrate, opposite the first side. In some embodiments the first plurality of radiating elements extend to an edge of the unit cell and the second plurality of radiating elements overlap portions of the first plurality of radiating elements. The method further comprises coupling one or more feed pins to the first plurality of radiating elements and to a signal source for transmission.

Further areas of applicability will become apparent from the description provided herein. It should be understood that the description and specific examples are intended for purposes of illustration only and are not intended to limit the scope of the present disclosure

BRIEF DESCRIPTION OF THE DRAWINGS

Embodiments of methods and systems in accordance with the teachings of the present disclosure are described in detail below with reference to the following drawings.

DETAILED DESCRIPTION

Configurations for antenna unit cells suitable for use in array antenna systems, and antenna systems incorporating such unit cells are described herein. Specific details of certain embodiments are set forth in the following description and the associated figures to provide a thorough understanding of such embodiments. One skilled in the art will understand, however, that alternate embodiments may be practiced without several of the details described in the following description.

The invention may be described herein in terms of functional and/or logical block components and various processing steps. For the sake of brevity, conventional techniques related to electronic warfare, radar, signal intelligence systems, data transmission, signaling, network control, and other functional aspects of the systems (and the individual operating components of the systems) may not be described in detail herein. Furthermore, the connecting lines shown in the various figures contained herein are intended to represent example functional relationships and/or physical couplings between the various elements. It should be noted that many alternative or additional functional relationships or physical connections may be present in a practical embodiment.

The following description may refer to components or features being "connected" or "coupled" or "bonded" together. As used herein, unless expressly stated otherwise, "connected" means that one component/feature is in direct physically contact with another component/feature. Likewise, unless expressly stated otherwise, "coupled" or "bonded" means that one component/feature is directly or indirectly joined to (or directly or indirectly communicates with) another component/feature, and not necessarily directly physically connected. Thus, although the figures may depict example arrangements of elements, additional intervening elements, devices, features, or components may be present in an actual embodiment.

Figure 1:
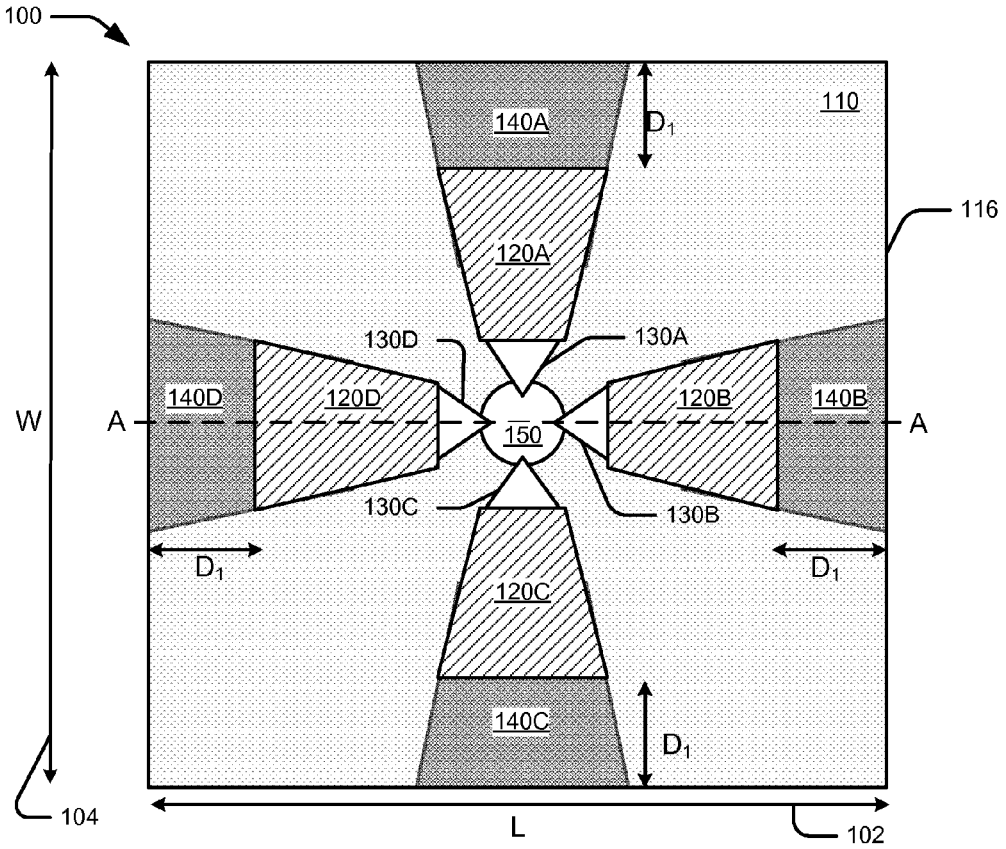
FIG. 1 is a schematic top-view of an antenna unit cell, according to embodiments.
Figure 2:
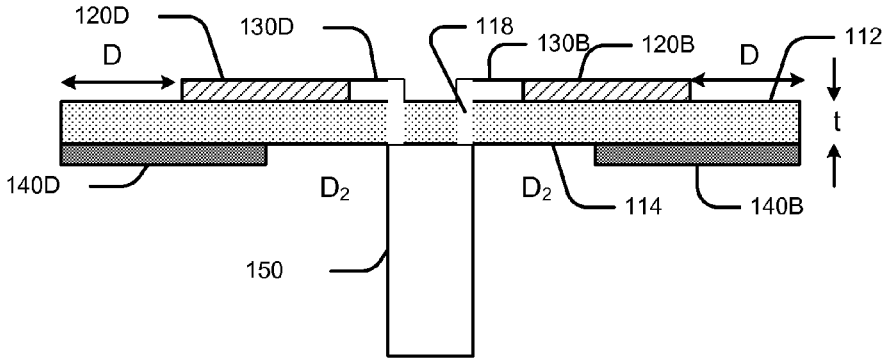
FIG. 2 is a schematic side elevation view of the antenna unit cell depicted in FIG. 1.

FIG. 1 is a schematic top-view of an antenna unit cell, according to embodiments, and FIG. 2 is a schematic side elevation view of the antenna unit cell depicted in FIG. 1. Referring to FIGS. 1-2, in some embodiments an antenna unit cell 100 comprises a dielectric substrate 110 having a length, L, extending along a first axis 102 and a width, W, extending along a second axis 104, and a thickness, t. In some embodiments the antenna unit cell 100 is adapted to operate in a frequency range extending from about 300.0 MHz to 3.0 GHz, (i.e., a wavelength of about 100 cm to 10 cm). In such embodiments the length L and the width W measure between about 1.5 inches (38.1 mm) and 2.0 inches (50.8 mm) and the thickness, t, of the substrate measures approximately 30 mils (0.762 mm). The design scales geometrically to any 10:1 band (i.e., 2-20 GHz, 0.5-5 GHz). One skilled in the art will recognize that the particular dimensions of the antenna unit cell 100 may be a function of the design frequency as well as materials and physical configuration of the unit cell. In some embodiments the substrate 110 may be formed from a conventional substrate, e.g., a Rogers 4350 series dielectric material.

A first plurality of radiating elements 120A, 120B, 120C, 120D, which may be referred to collectively by reference numeral 120, are disposed on a first side 112 of the dielectric substrate 110. Radiating elements 120 may be coupled to a feed line 150 via one or more contacts 130A, 130B, 130C, 130D, which may be referred to collectively by reference numeral 130, such that radiating elements 120 define a feed network. In some embodiments the contacts 130 extend through vias 118 formed in the substrate 110. In some embodiments the contacts 130 may be formed integrally with the radiating elements, while in other embodiments the contacts 130 may be formed separately and electrically coupled to the radiating elements. In some embodiments the first plurality of radiating elements 120 measure between about 0.5 inches and 0.7 inches in length and extend from the central feed line 150 to a point that is a distance D from the edge 116 of the unit cell. In some embodiments the distance $D_1$ may measure between 0.13 inches (3.3 mm) and 0.18 inches (4.57 mm).

A second plurality of radiating elements 140A, 140B, 140C, 140D, which may be referred to collectively by reference numeral 140 are disposed on a second side 114 of the dielectric substrate 110. In some embodiments the second plurality of radiating elements 140 overlap portions of the first radiating elements 140, such that the second plurality of radiating elements 140 may be capacitively coupled to the first plurality of radiating elements 120 that define the feed network. In some embodiments the first plurality of radiating elements 120 measure between about 0.5 inches and 0.8 inches in length and extend from the edge 116 of the unit cell 110 to a point that is a distance $D_2$ from the feed line 150 of the unit cell. In some embodiments the distance $D_2$ may measure between 0.2 inches (5.08 mm) and 0.5 inches (12.7 mm).

In the embodiment depicted in FIGS. 1-2 the radiating elements 120 are substantially trapezoidal in shape and are arranged to form opposing bow-tie shaped radiating elements. The bow-tie radiating elements are oriented at ninety (90) degrees with respect to one another to provide a dual-polarization antenna structure. One skilled in the art will recognize that the radiating elements 120, 140 may be formed in various shapes and sizes.

Figure 3:
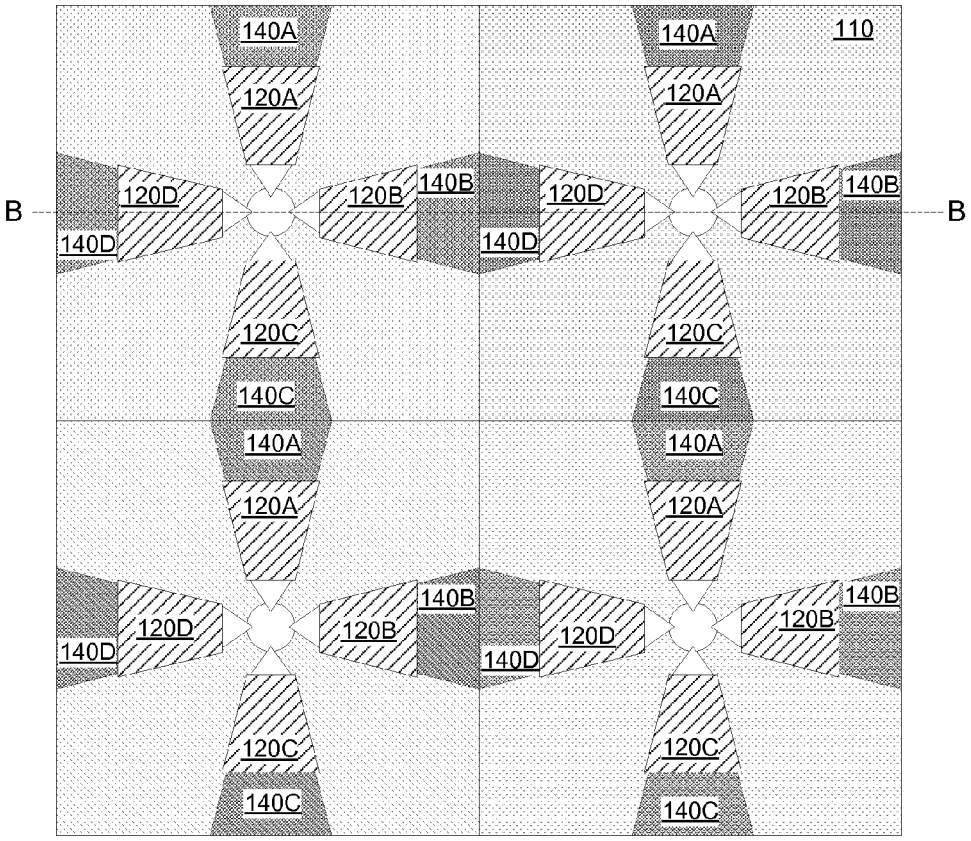
FIG. 3 is a schematic top, plan view of an antenna array formed from a plurality of unit cells, according to embodiments.
Figure 4:
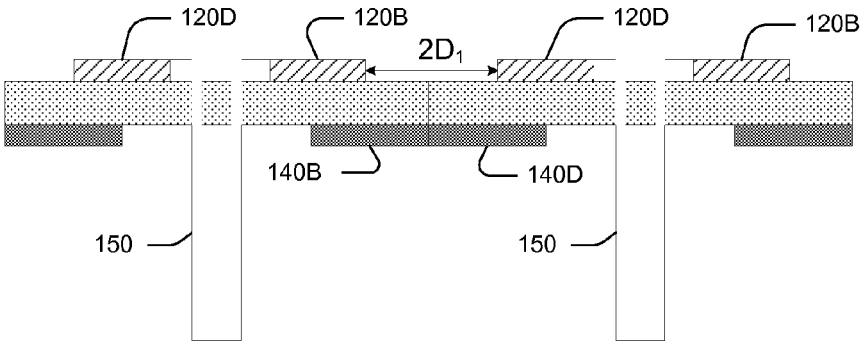
FIG. 4 is a schematic side elevation view of the antenna array depicted in FIG. 3.

In practice, a plurality of unit cells 110 may be positioned adjacent one another to define an antenna array. FIG. 3 is a schematic top, plan view of an antenna array formed from a plurality of unit cells, according to embodiment, and FIG. 4 is a schematic side elevation view of the antenna array depicted in FIG. 3. In the embodiment depicted in FIGS. 3-4, four antenna unit cells 100 are arranged to form a 2×2 antenna array. One skilled in the art will recognize that any number of unit cells may be combined to form an m×n antenna array.

Referring to FIGS. 3-4, in relevant part when the antenna unit cells 100 are arranged to form a 2×2 array adjacent radiating elements in the first plurality of radiating elements 120 are separated by a distance that measures twice the distance $D_1$, i.e., $2D_1$. Thus, referring to FIGS. 3-4, adjacent elements 120A and 120C are separated by a distance of $2D_1$, as are elements 120B and 120D. By contrast, adjacent radiating elements in the second plurality of radiating elements 140 are in electrical contact with one another. Thus, as illustrated in FIGS. 3-4, radiating elements 140A, 140C are electrically connected, as are radiating elements 140B, 140D.

Figure 5:
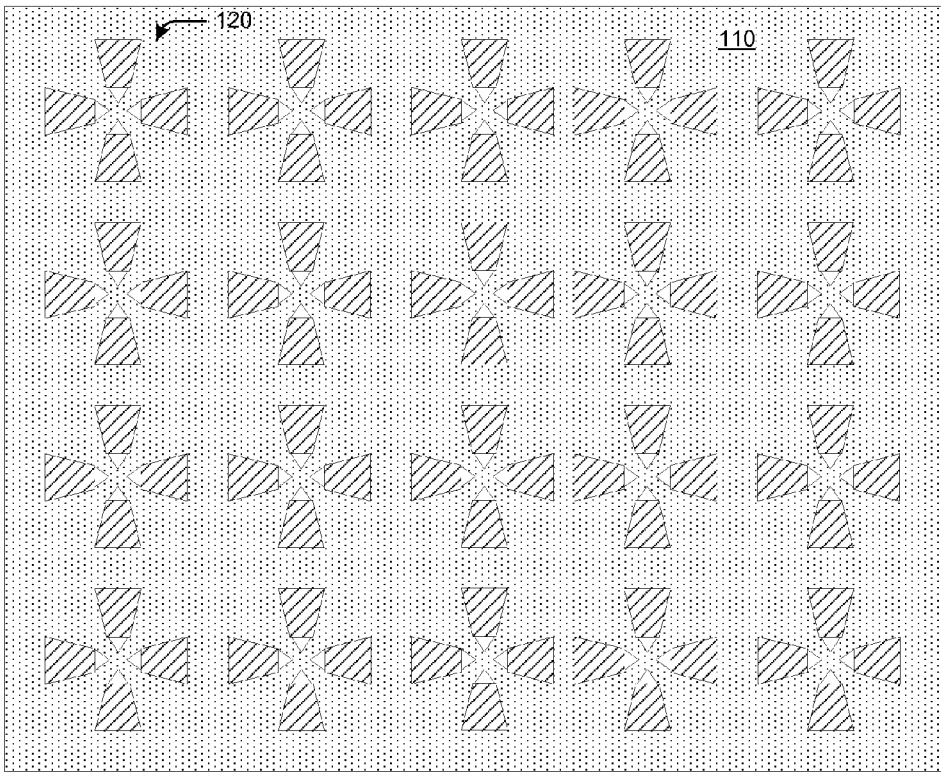
FIG. 5 is a schematic top, plan view of a printed antenna array, according to embodiments.
Figure 6:
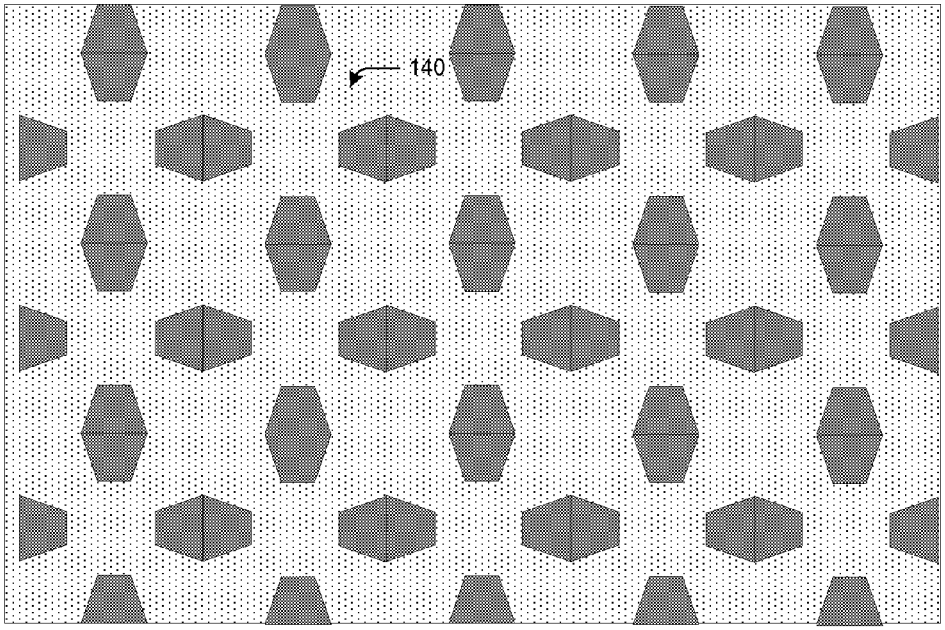
FIG. 6 is a schematic bottom, plan view of a printed antenna array, according to embodiments.

In some embodiments the antenna assembly may be formed by printing the respective radiating elements 120, 140 on opposing sides of a sheet of dielectric substrate. This may be illustrated with respect to FIGS. 5-6. FIG. 5 is a schematic top, plan view of a printed antenna assembly, according to embodiments, and FIG. 6 is a schematic bottom, plan view of a printed antenna assembly, according to embodiments. Referring to FIG. 5-6, a pattern of radiating elements 120 may be printed on a first surface of a substrate 110, while a pattern of radiating elements 140 may be printed on the opposing second surface of substrate 110. The resulting sheet may then be cut as desired to form an m×n array of antenna elements.

Figure 7:
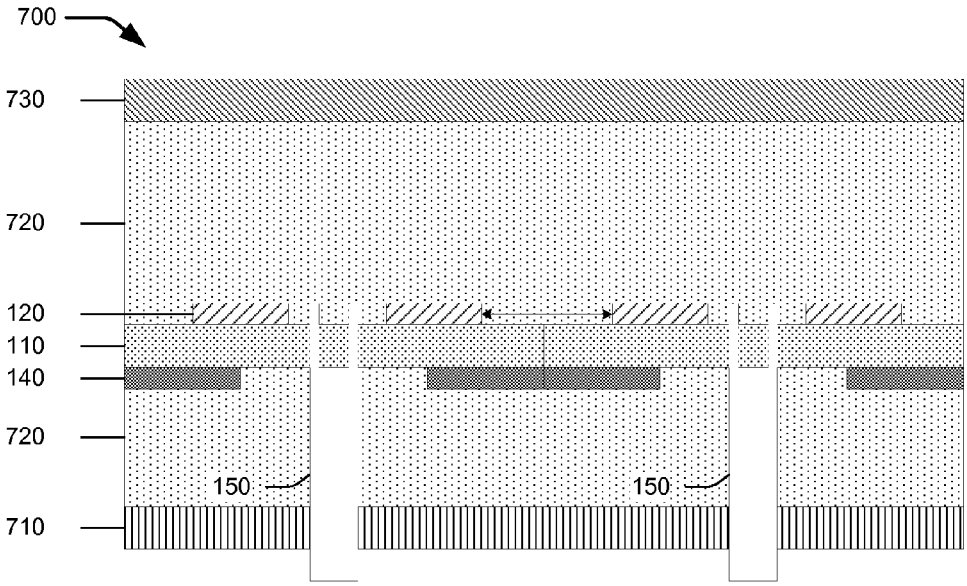
FIG. 7 is a schematic side elevation view illustration of an antenna assembly, according to embodiments.

FIG. 7 is a schematic illustration of an antenna assembly 700, according to embodiments. Referring to FIG. 7, in a conformal antenna assembly the substrate layer 110 and the printed radiating layers 120, 140 may be positioned between one or more foam layers 720 and a ground plane 710. Optionally, a cap layer 730 may be positioned over the foam layer 720. The feed pins 150 may be coupled to a signal source for transmission.

Figure 8:
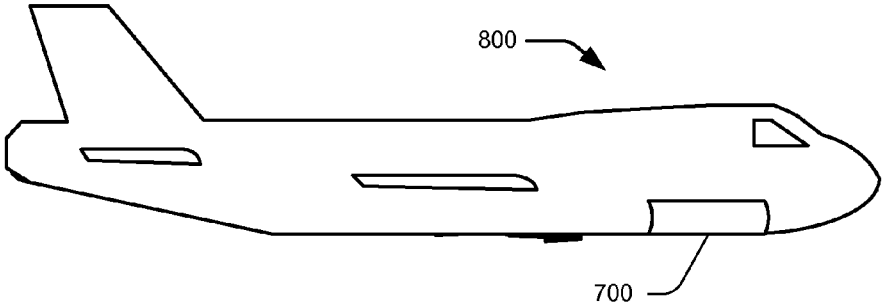
FIG. 8 is a schematic illustration of an aircraft-based communication, radar, or other RF sensor system which may incorporate an antenna, according to embodiments.

In some embodiments an aircraft-based antenna or phased array system may incorporate one or more antennas constructed according to embodiments described herein. By way of example, referring to FIG. 8, an antenna assembly 700 may be mounted on an aircraft 800, such as an airplane, helicopter, spacecraft or the like. In alternate embodiments an antenna assembly 700 may be mounted on a ground-based vehicle such as a truck, tank, train, or the like, or on a water-based vehicle such as a ship. In further embodiments an antenna 700 may be mounted on a land-based communication station.

Figure 9:
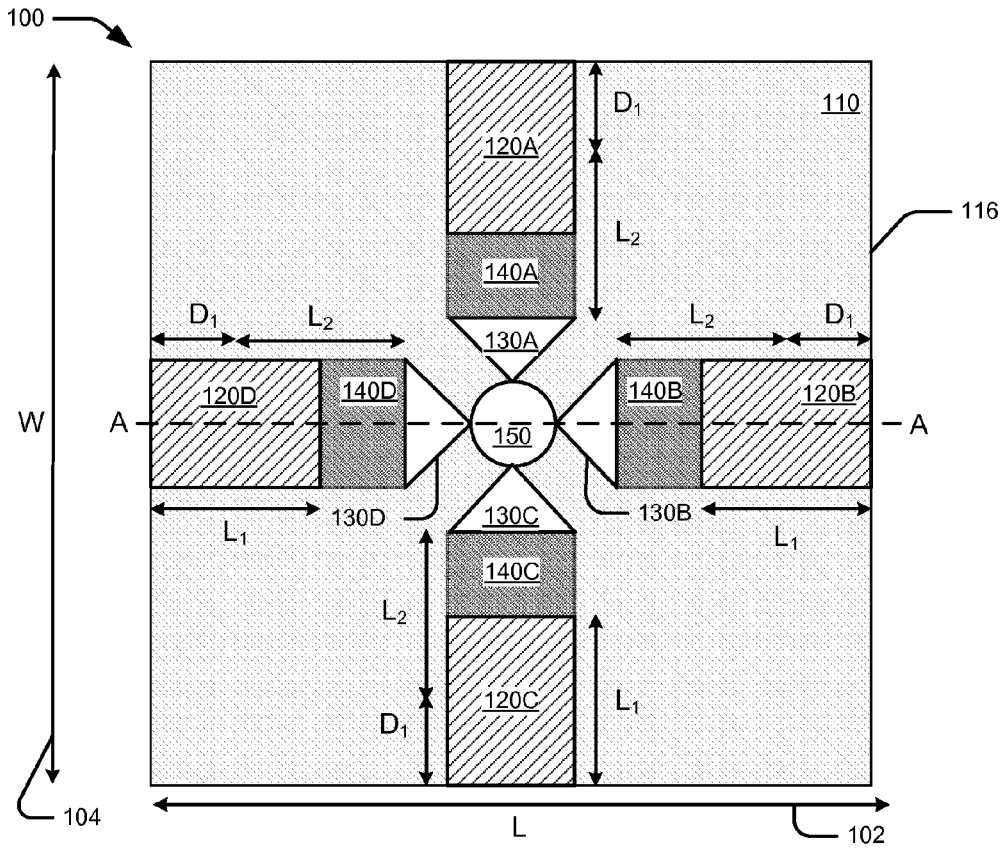
FIG. 9 is a schematic top-view of an antenna unit cell, according to embodiments.
Figure 10:
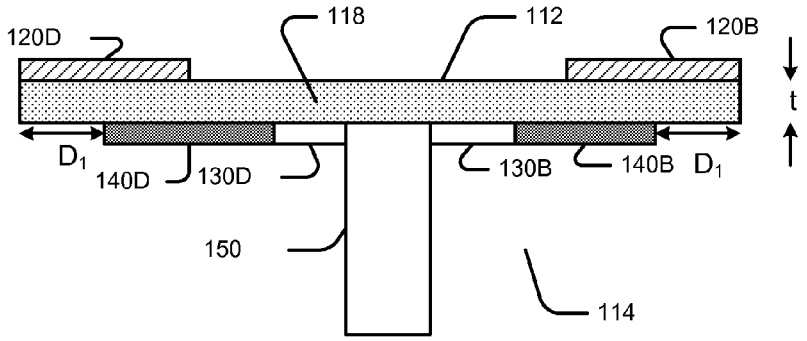
FIG. 10 is a schematic side elevation view of the antenna unit cell depicted in FIG. 9.

An alternate embodiment of an antenna unit cell is described with reference to FIGS. 9-14. FIG. 9 is a schematic top-view of an antenna unit cell, according to embodiments, and FIG. 10 is a schematic side elevation view of the antenna unit cell depicted in FIG. 9. Referring to FIGS. 9-10, in some embodiments an antenna unit cell 100 comprises a dielectric substrate 110 having a length, L, extending along a first axis 102 and a width, W, extending along a second axis 104, and a thickness, t. In some embodiments the antenna unit cell 100 is adapted to operate in a frequency range extending from about 300.0 MHz to 3.0 GHz, (i.e., a wavelength of about 100 cm to 10 cm). In such embodiments the length L and the width W measure between about 1.5 inches (38.1 mm) and 2.0 inches (50.8 mm) and the thickness, t, of the substrate measures approximately 30 mils (0.762 mm). The design scales geometrically to any 10:1 band (i.e., 2-20 GHz, 0.5-5 GHz). One skilled in the art will recognize that the particular dimensions of the antenna unit cell 100 may be a function of the design frequency as well as materials and physical configuration of the unit cell. In some embodiments the substrate 110 may be formed from a conventional substrate, e.g., a Rogers 4350 series dielectric material.

A first plurality of radiating elements 120A, 120B, 120C, 120D, which may be referred to collectively by reference numeral 120, are disposed on a first side 112 of the dielectric substrate 110. A second plurality of radiating elements 140A, 140B, 140C, 140D, which may be referred to collectively by reference numeral 140 are disposed on a second side 114 of the dielectric substrate 110. Radiating elements 140 may be coupled to a feed line 150 via one or more contacts 130A, 130B, 130C, 130D, which may be referred to collectively by reference numeral 130, such that radiating elements 140 define a feed network. In some embodiments the contacts 130 may be formed integrally with the radiating elements 140, while in other embodiments the contacts 130 may be formed separately and electrically coupled to the radiating elements. In some embodiments the first plurality of radiating elements 120 measure between about 0.5 inches and 0.7 inches in length ($L_1$) and extend from the edge 116 of the unit cell to a point between approximately 0.25 inches and 0.45 inches from the central feed line 150.

In some embodiments the second plurality of radiating elements 140 overlap portions of the first radiating elements 120, such that the first plurality of radiating elements 120 may be capacitively coupled to the second plurality of radiating elements 140 that define the feed network. In some embodiments the second plurality of radiating elements 120 measure between about 0.5 inches and 0.8 inches in length and extend the feed line connector 130 to a point to a point that is a distance $D_1$ from the edge 116 of the unit cell 110. In some embodiments the distance $D_1$ may measure between 0.10 inches and 0.40 inches.

In the embodiment depicted in FIGS. 9-10 the radiating elements 120 are substantially rectangular in shape and are arranged to form opposing dipoles. The radiating elements are oriented at ninety (90) degrees with respect to one another to provide a dual-polarization antenna structure. One skilled in the art will recognize that the radiating elements 120, 140 may be formed in various shapes and sizes.

Figure 11:
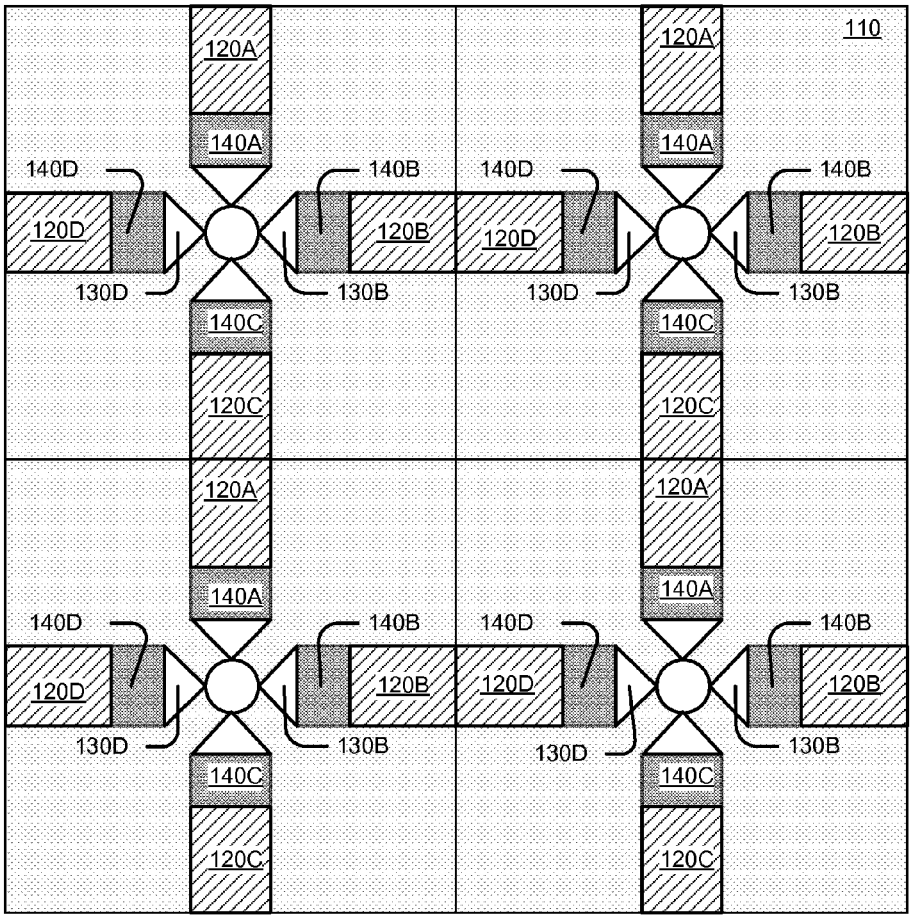
FIG. 11 is a schematic top, plan view of an antenna array formed from a plurality of unit cells, according to embodiments.
Figure 12:
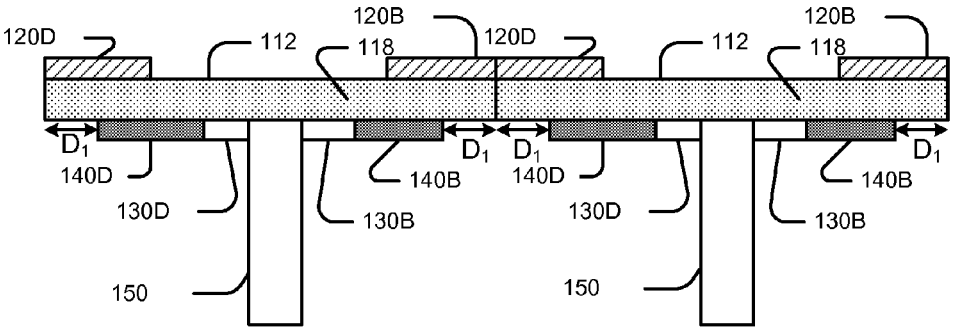
FIG. 12 is a schematic side elevation view of the antenna array depicted in FIG. 9.

In practice, a plurality of unit cells 110 may be positioned adjacent one another to define an antenna array. FIG. 11 is a schematic top, plan view of an antenna array formed from a plurality of unit cells, according to embodiment, and FIG. 12 is a schematic side elevation view of the antenna array depicted in FIG. 11. In the embodiment depicted in FIGS. 11-12, four antenna unit cells 100 are arranged to form a 2×2 antenna array. One skilled in the art will recognize that any number of unit cells may be combined to form an m×n antenna array.

Referring to FIGS. 11-12, in relevant part when the antenna unit cells 100 are arranged to form a 2×2 array adjacent radiating elements in which the second plurality of radiating elements 140 are separated by a distance that measures twice the distance $D_1$, i.e., $2D_1$. Thus, referring to FIGS. 11-12, adjacent elements 140A and 140C are separated by a distance of $2D_1$, as are elements 140B and 140D. By contrast, adjacent radiating elements in the first plurality of radiating elements 120 are in electrical contact with one another. Thus, as illustrated in FIGS. 11-12, radiating elements 120A, 120C are electrically connected, as are radiating elements 120B, 120D.

Figure 13:
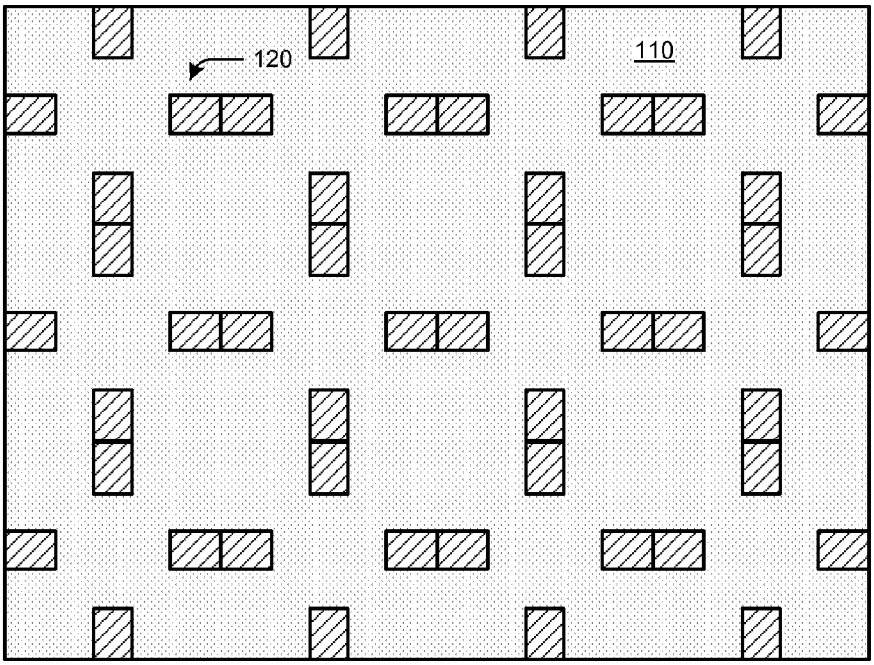
FIG. 13 is a schematic top, plan view of a printed antenna array, according to embodiments.
Figure 14:
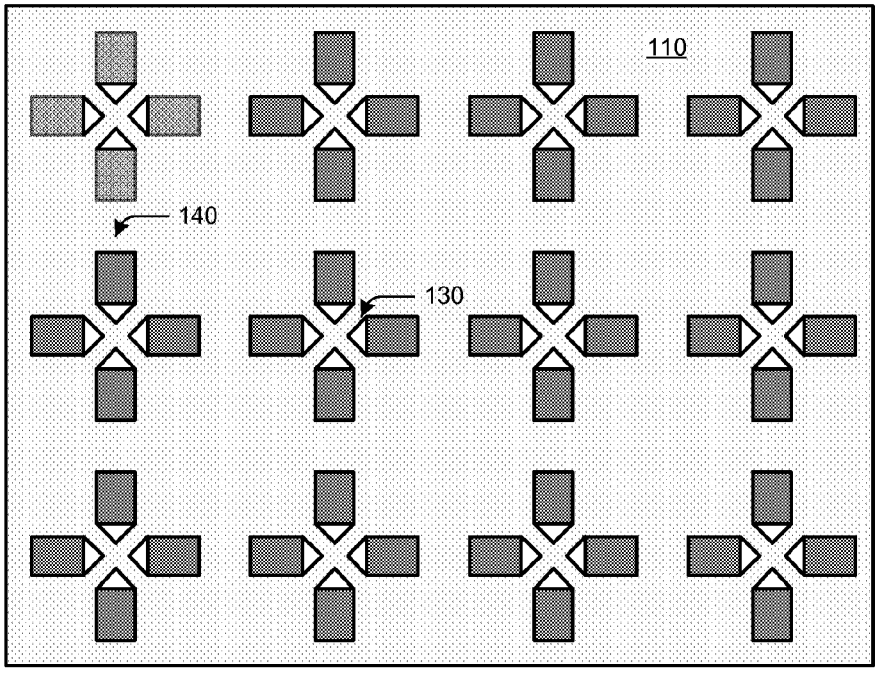
FIG. 14 is a schematic bottom, plan view of a printed antenna array, according to embodiments.

In some embodiments the antenna assembly may be formed by printing the respective radiating elements 120, 140 on opposing sides of a sheet of dielectric substrate. This may be illustrated with respect to FIGS. 13-14. FIG. 13 is a schematic bottom, plan view of a printed antenna assembly, according to embodiments, and FIG. 14 is a schematic top, plan view of a printed antenna assembly, according to embodiments. Referring to FIG. 13-14, a pattern of radiating elements 120 may be printed on a first surface of a substrate 110, while a pattern of feed connectors 130 and radiating elements 140 may be printed on the opposing second surface of substrate 110. The resulting sheet may then be cut as desired to form an m×n array of antenna elements.

Analogous to the assembly depicted in FIG. 7, a conformal antenna assembly the substrate layer 110 and the printed radiating layers 120, 140 may be positioned between one or more foam layers 720 and a ground plane 710. Optionally, a cap layer 730 may be positioned over the foam layer 720. The feed pins 150 may be coupled to a signal source for transmission. The antenna may be mounted on an aircraft or other vehicle, as described with reference to FIG. 8.

Thus, described herein is an ultra-wide band (UWB) antenna unit cell and assembly. The antenna element may be used in the creation of wide-band arrays and/or conformal antennas that achieves ultra wide bandwidth (i.e., a 10:1 frequency band edge ratio), the ability to perform over wide scan angles, and provides both dual and separable RF polarization capability. In some embodiments the unit cell that employs a multi-layer circuit that comprises a bow-tie fan feed layer, and a layer comprising bow-tie based connected array. The circuit board may be placed over a ground plane with foam dielectric layers below and above the antenna circuit board to create the antenna element structure. A differential feed from bow-tie like fan elements is coupled capacitively to the underlying unit-cell to unit-cell connected bow-tie element layer. Such an antenna has wide applicability to communication phased antenna arrays (PAA), signal intelligence sensors and detection sensor arrays, wide band radar systems, and phased arrays used in electronic warfare.

An antenna element manufactured in accordance herewith exhibits ultra-wide bandwidth and better than 55-degree conical scan volume for the creation of conformal arrays and antennas. The design approach provides effective gain within 2 dB of the ideal gain possible for the surface area of the unit-cell for the element. The element design can be used as a wide-band antenna and/or array. The design can be scaled to any frequency band with a 10:1 ratio from the highest to the lowest frequency of desired coverage.

While various embodiments have been described, those skilled in the art will recognize modifications or variations which might be made without departing from the present disclosure. The examples illustrate the various embodiments and are not intended to limit the present disclosure. Therefore, the description and claims should be interpreted liberally with only such limitation as is necessary in view of the pertinent prior art.

What is claimed is:

1. An antenna unit cell, comprising:

a dielectric substrate;

first radiating elements disposed on a first side of the dielectric substrate, wherein a radiating element of the first radiating elements extends to an edge of the antenna unit cell, wherein no radiating element of the first radiating elements is electrically coupled to another radiating element of the first radiating elements, and wherein no radiating element of the first radiating elements is electrically coupled to a feed connector; and second radiating elements disposed on a second side of the dielectric substrate, opposite the first side, wherein the second radiating elements overlap portions of the first plurality of radiating elements, and wherein each radiating element of the second radiating elements is coupled to the feed connector on the second side, wherein the second radiating elements comprise four radiating elements arranged as opposing pairs of elements relative to the feed connector.

2. The antenna unit cell of claim 1, further comprising a feed line coupled to the feed connector.

3. The antenna unit cell of claim 1, wherein:

the first radiating elements are rectangular in shape and arranged to form opposing dipoles disposed about the feed connector; and the second radiating elements are rectangular in shape.

4. The antenna unit cell of claim 1, wherein each radiating element of the second radiating elements overlaps only one radiating element of the first radiating elements.

5. The antenna unit cell of claim 1, wherein:

the first radiating elements are disposed on an upper surface of the dielectric substrate;

the second radiating elements are disposed on a lower surface of the dielectric substrate; and the feed connector is directly coupled to the second radiating elements.

6. The antenna unit cell of claim 1, wherein:

the first radiating elements are disposed on a lower surface of the dielectric substrate;

the second radiating elements are disposed on an upper surface of the dielectric substrate; and the feed connector is coupled directly to the second radiating elements through one or more vias in the dielectric substrate.

7. The antenna unit cell of claim 1, wherein the edge is adjacent to a second edge of a second unit cell, and wherein a particular radiating element of the second unit cell electrically interconnects with the radiating element.

8. An antenna array comprising:

a unit cell, the unit cell comprising:

a dielectric substrate;

first radiating elements disposed on a first side of the dielectric substrate, wherein a radiating element of the first radiating elements extends to an edge of the unit cell, wherein no radiating element of the first radiating elements is electrically coupled to another radiating element of the first radiating elements, and wherein no radiating element of the first radiating elements is electrically coupled to a feed connector; and second radiating elements disposed on a second side of the dielectric substrate, opposite the first side, wherein the second radiating elements overlap portions of the first plurality of radiating elements, and wherein each radiating element of the second radiating elements is coupled to the feed connector on the second side; and a second unit cell, the second unit cell comprising:

third radiating elements disposed on the first side of the dielectric substrate, wherein a particular radiating element of the third radiating elements extends to second edge of the second unit cell, wherein the edge and the second edge are adjacent, wherein the particular radiating element is not electrically coupled to any feed connector, wherein the unit cell does not include the particular radiating element, wherein the second unit cell does not include the radiating element, and wherein the particular radiating element electrically interconnects with the radiating element; and fourth radiating elements disposed on the second side of the dielectric substrate, wherein none of the fourth radiating elements electrically interconnect with any of the second radiating elements.

9. The antenna array of claim 8, wherein the unit cell comprises a feed line coupled to the feed connector.

10. The antenna array of claim 8, wherein:

the first radiating elements are rectangular in shape and arranged to form opposing dipoles disposed about the feed connector; and the second radiating elements are rectangular in shape.

11. The antenna array of claim 8, wherein the second radiating elements comprise four radiating elements arranged as opposing pairs of elements relative to the feed connector.

12. The antenna array of claim 8, wherein:

the first radiating elements are disposed on an upper surface of the dielectric substrate;

the second radiating elements are disposed on a lower surface of the dielectric substrate; and the feed connector is directly coupled to the second radiating elements.

13. The antenna array of claim 8, wherein:

the first radiating elements are disposed on a lower surface of the dielectric substrate;

the second radiating elements are disposed on an upper surface of the dielectric substrate; and the feed connector is coupled directly to the second radiating elements through one or more vias in the dielectric substrate.

14. The antenna array of claim 8, wherein the first radiating elements comprise four first radiating elements, wherein the second radiating elements comprise four second radiating elements coupled to the feed connector, the four second radiating elements arranged as opposing pairs of elements relative to the feed connector, and wherein each of the four first radiating elements corresponds to and overlaps with a particular second radiating element of the four second radiating elements.

15. An aircraft, comprising:

a communication system; and an antenna assembly coupled to the communication system and comprising:

a unit cell, the unit cell comprising:

a dielectric substrate;

first radiating elements disposed on a first side of the dielectric substrate, wherein a radiating element of the first radiating elements extends to an edge of the unit cell, wherein no radiating element of the first radiating elements is electrically coupled to another radiating element of the first radiating elements, and wherein no radiating element of the first radiating elements is electrically coupled to a feed connector; and second radiating elements disposed on a second side of the dielectric substrate, opposite the first side, wherein the second radiating elements overlap portions of the first plurality of radiating elements, and wherein each radiating element of the second radiating elements is coupled to the feed connector on the second side; and a second unit cell, the second unit cell comprising:

third radiating elements disposed on the first side of the dielectric substrate, wherein a particular radiating element of the third radiating elements extends to second edge of the second unit cell, wherein the edge and the second edge are adjacent, wherein the particular radiating element is not electrically coupled to any feed connector, wherein the unit cell does not include the particular radiating element, wherein the second unit cell does not include the radiating element, and wherein the particular radiating element electrically interconnects with the radiating element; and fourth radiating elements disposed on the second side of the dielectric substrate, wherein none of the fourth radiating elements electrically interconnect with any of the second radiating elements.

16. The aircraft of claim 15, wherein the unit cell comprises a feed line coupled to the feed connector.

17. The aircraft of claim 15, wherein:

the first radiating elements are rectangular in shape and arranged to form opposing dipoles disposed about the feed connector; and the second radiating elements are rectangular in shape.

18. The aircraft of claim 15, wherein each radiating element of the second radiating elements overlaps only one radiating element of the first radiating elements.

19. The aircraft of claim 15, wherein:

the first radiating elements are disposed on an upper surface of the dielectric substrate;

the second radiating elements are disposed on a lower surface of the dielectric substrate; and the feed connector is directly coupled to the second radiating elements.

20. The aircraft of claim 15, wherein:

the first radiating elements are disposed on a lower surface of the dielectric substrate;

the second radiating elements are disposed on an upper surface of the dielectric substrate; and the feed connector is coupled directly to the second radiating elements through one or more vias in the dielectric substrate.

21. The aircraft of claim 15, wherein the second radiating elements comprise four radiating elements arranged as opposing pairs of elements relative to the feed connector.

22. A method to use an antenna assembly, comprising:

providing an antenna array comprising:

a unit cell, the unit cell comprising:

a dielectric substrate;

first radiating elements disposed on a first side of the dielectric substrate, wherein a radiating element of the first radiating elements extends to an edge of the unit cell, wherein no radiating element of the first radiating elements is electrically coupled to another radiating element of the first radiating elements, and wherein no radiating element of the first radiating elements is electrically coupled to a feed connector;

second radiating elements disposed on a second side of the dielectric substrate, opposite the first side, wherein the second radiating elements overlap portions of the first plurality of radiating elements, and wherein each radiating element of the second radiating elements is coupled to the feed connector on the second side;

a second unit cell, the second unit cell comprising:

third radiating elements disposed on the first side of the dielectric substrate, wherein a particular radiating element of the third radiating elements extends to second edge of the second unit cell, wherein the edge and the second edge are adjacent, wherein the particular connector, wherein the unit cell does not include the particular radiating element, wherein the second unit cell does not include the radiating element, and wherein the particular radiating element electrically interconnects with the radiating element; and fourth radiating elements disposed on the second side of the dielectric substrate, wherein none of the fourth radiating elements electrically interconnect with any of the second radiating elements; and coupling a feed pin to the feed connector and to a signal source for transmission.

23. The method of claim 22, further comprising mounting the antenna assembly to an aircraft, a naval based platform, or a ground based platform.

24. An antenna array comprising:

a unit cell, the unit cell comprising:

a dielectric substrate;

first radiating elements disposed on a first side of the dielectric substrate, wherein a radiating element of the first radiating elements extends to an edge of the unit cell, wherein no radiating element of the first radiating elements is electrically coupled to another radiating element of the first radiating elements, and wherein no radiating element of the first radiating elements is electrically coupled to a feed connector; and second radiating elements disposed on a second side of the dielectric substrate, opposite the first side, wherein the second radiating elements overlap portions of the first plurality of radiating elements, and wherein each radiating element of the second radiating elements is coupled to the feed connector;

wherein the first radiating elements comprise four first radiating elements, wherein the second radiating elements comprise four second radiating elements coupled to the feed connector, the four second radiating elements arranged as opposing pairs of elements relative to the feed connector, and wherein each of the four first radiating elements corresponds to and overlaps with a particular second radiating element of the four second radiating elements.

25. The antenna array of claim 24, wherein the unit cell comprises a feed line coupled to the feed connector.

26. The antenna array of claim 24, wherein the first radiating elements are rectangular in shape and arranged to form opposing dipoles disposed about the feed connector, and wherein the second radiating elements are rectangular in shape.

* * * * *